US007348834B2

(12) United States Patent
Itoh

(10) Patent No.: US 7,348,834 B2
(45) Date of Patent: Mar. 25, 2008

(54) SELECTING A REFERENCE VOLTAGE SUITABLE TO LOAD FUNCTIONALITY

(75) Inventor: Kohzoh Itoh, Hyogo-ken (JP)

(73) Assignee: Ricoh Company, Ltd., Tokyo (JP)

( * ) Notice: Subject to any disclaimer, the term of this patent is extended or adjusted under 35 U.S.C. 154(b) by 164 days.

(21) Appl. No.: 10/987,695

(22) Filed: Nov. 12, 2004

(65) Prior Publication Data

US 2005/0099224 A1 May 12, 2005

(30) Foreign Application Priority Data

Nov. 12, 2003 (JP) ..... 2003-382835

(51) Int. Cl.
*G05F 1/10* (2006.01)

(52) U.S. Cl. ..... 327/539; 327/407

(58) Field of Classification Search ..... 323/313, 323/314; 327/407, 408, 411, 534, 535, 537, 327/538, 539, 540, 541, 543
See application file for complete search history.

(56) References Cited

U.S. PATENT DOCUMENTS 4,417,263 A 11/1983 Matsuura
5,359,552 A * 10/1994 Dhong et al. ..... 365/189.09
5,712,590 A * 1/1998 Dries et al. ..... 327/539
5,909,449 A * 6/1999 So et al. ..... 714/721
6,437,550 B2 8/2002 Andoh et al.
6,600,305 B2 7/2003 Andoh et al.
6,642,776 B1 * 11/2003 Micheloni et al. ..... 327/539
6,710,642 B1 * 3/2004 Tang et al. ..... 327/539
6,724,176 B1 * 4/2004 Wong et al. ..... 323/316
6,876,585 B2 * 4/2005 Choi et al. ..... 365/189.09
6,936,998 B2 * 8/2005 Cho ..... 323/280
7,050,338 B2 * 5/2006 Shuto ..... 365/189.09
2002/0180453 A1 12/2002 Itoh
2004/0004851 A1 1/2004 Itoh

FOREIGN PATENT DOCUMENTS

JP 62-150935 7/1987
JP 7-107676 4/1995
JP 2001-284464 10/2001

* cited by examiner

*Primary Examiner*—Jeffrey Zweizig
(74) *Attorney, Agent, or Firm*—Cooper & Dunham LLP

(57) ABSTRACT

An integrated circuit capable of detecting or generating a reference voltage suitable to a functionality of an electronic device is disclosed. The integrated circuit includes a plurality of reference voltage generating circuits, having characteristics different from one another, and a controller, which selects one of the plurality of reference voltage generating circuits according to the functionality of the electronic device.

51 Claims, 7 Drawing Sheets

SELECTING A REFERENCE VOLTAGE SUITABLE TO LOAD FUNCTIONALITY

FIELD

The present invention generally relates to selecting a reference voltage suitable to a functionality of a load. In particular, the present invention relates to an integrated circuit capable of detecting or generating a reference voltage suitable to a functionality of an electronic device.

DISCUSSION OF THE BACKGROUND

Portable electronic devices require low power consumption to achieve longer battery life. To reduce power consumption without sacrificing performance and functionality, the portable electronic devices are conventionally controlled in two modes, including a standby mode and a normal mode. For example, when the electronic device is not in use, the device is placed in the standby mode to reduce power consumption. However, this conventional method fails to achieve reduced power consumption during the normal mode.

SUMMARY OF THE INVENTION

This patent specification describes a novel integrated circuit, capable of detecting or generating a reference voltage suitable to a functionality of an electronic device. The integrated circuit includes a plurality of reference voltage generating circuits, having characteristics different from one another, and a controller configured to select one of the plurality of reference voltage generating circuits according to the functionality of the electronic device.

For example, when the electronic device has a functionality preferring low power consumption, the controller selects the reference voltage generating circuit, having a low power consumption rate. When the electronic device has a functionality preferring constant voltage supply, the controller selects the reference voltage generating circuit, having a low temperature sensitivity and/or a high voltage accuracy.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
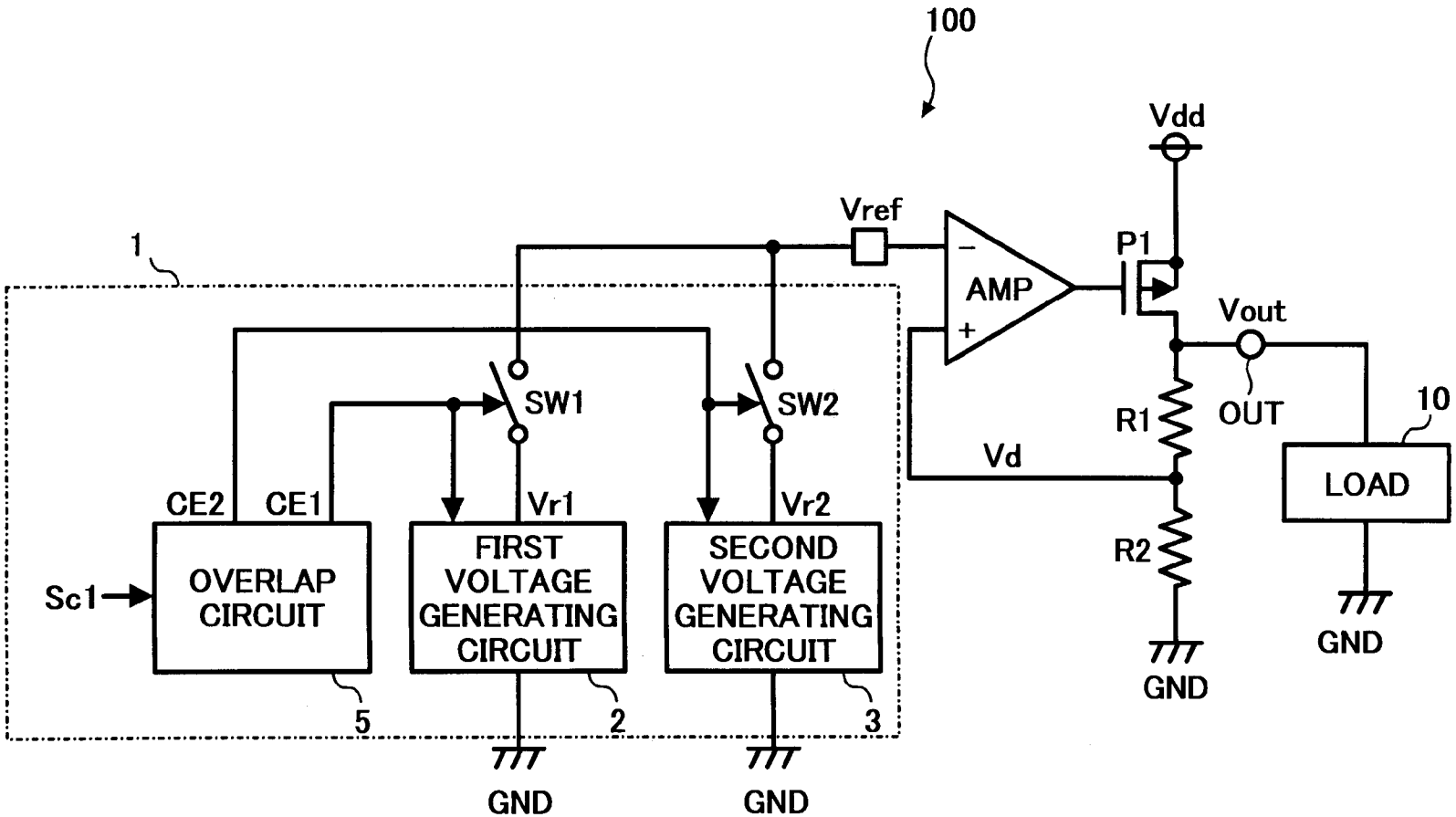
FIG. 1 is a schematic circuit diagram illustrating an integrated circuit according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a description is made of an integrated circuit 100 according to an exemplary embodiment of the present invention.

The integrated circuit 100 functions as a reference voltage source circuit, capable of providing constant voltage supply to a load 10. Specifically, the integrated circuit 100 determines a reference voltage Vref suitable to a functionality of the load 10, generates an output voltage Vout based on the reference voltage Vref, and provides the output voltage Vout to the load 10.

The integrated circuit 100 may be incorporated in an electronic circuit of a portable electronic device, such as a personal digital assistant (PDA) device, portable telephone, and a portable audio device, for example.

As shown in FIG. 1, the integrated circuit 100 includes a reference voltage generating circuit 1, an output terminal OUT, an output driver P1, an amplifier AMP, a first resistor R1, and a second resistor R2.

The reference voltage generating circuit 1, which generates a reference voltage Vref, is connected to the negative input terminal of the amplifier AMP. The output driver P1, the first resistor R1 and the second resistor R2 are connected in series between the power source Vdd and the ground GND. The junction of the output driver P1 and the first resistor R1 is connected to the output terminal OUT. The junction of the first resistor R1 and the second resistor R2 is connected to the positive input terminal of the amplifier AMP. The gate of the output driver P1 is connected to the output terminal of the amplifier AMP. Further, the load 10 is provided between the output terminal OUT and the ground GND.

In this circuit 100, the resistors R1 and R2 together function as a voltage divider, capable of dividing the output voltage Vout into a divided voltage Vd. The amplifier AMP, which may be referred to as a comparator of any kind, compares the divided voltage Vd with the reference voltage Vref. Based on this comparison, the output driver P1, which may be implemented as a P-channel MOS transistor, controls the divided voltage Vd to be substantially equal to the reference voltage Vref.

As shown in FIG. 1, the reference voltage generating circuit 1 includes a first reference voltage generating circuit 2 (hereinafter, referred to as the "first voltage generating circuit 2" as shown), a second reference voltage generating circuit 3 (hereinafter, referred to as the "second voltage generating circuit 3" as shown), a first switch SW1, a second switch SW2, and an overlap circuit 5.

The first voltage generating circuit 2 has one terminal connected to the ground GND, and the other terminal connected to the negative input terminal of the amplifier AMP via the first switch SW1. The second voltage generating circuit 3 has one terminal connected to the ground GND, and the other terminal connected to the negative input terminal of the amplifier AMP via the second switch SW2. The overlap circuit 5 connects the reference voltage generating circuit 1 with the outside system.

The first voltage generating circuit 2 and the second voltage generating circuit 3 have characteristics different from each other. Specifically, in this exemplary case, the power consumption rate of the first voltage generating circuit 2 is higher than that of the second voltage generating circuit 3. In addition, the temperature sensitivity of the first voltage generating circuit 2 is lower than that of the second voltage generating circuit 3. Further, the voltage accuracy of the first voltage generating circuit 2 is higher than that of the second voltage generating circuit 3.

In other words, the first voltage generating circuit 2 has an advantage over the second voltage generating circuit 3 of providing constant voltage supply. On the other hand, the second voltage generating circuit 3 has an advantage over the first voltage generating circuit 2 of consuming less power.

In operation, the overlap circuit 5 selects one of the first voltage generating circuit 2 and the second voltage generating circuit 3, by controlling the first switch SW1 and the second switch SW2. In this way, the reference voltage generating circuit 1 can generate a reference voltage Vref suitable to a functionality of the load 10.

Figure 2:
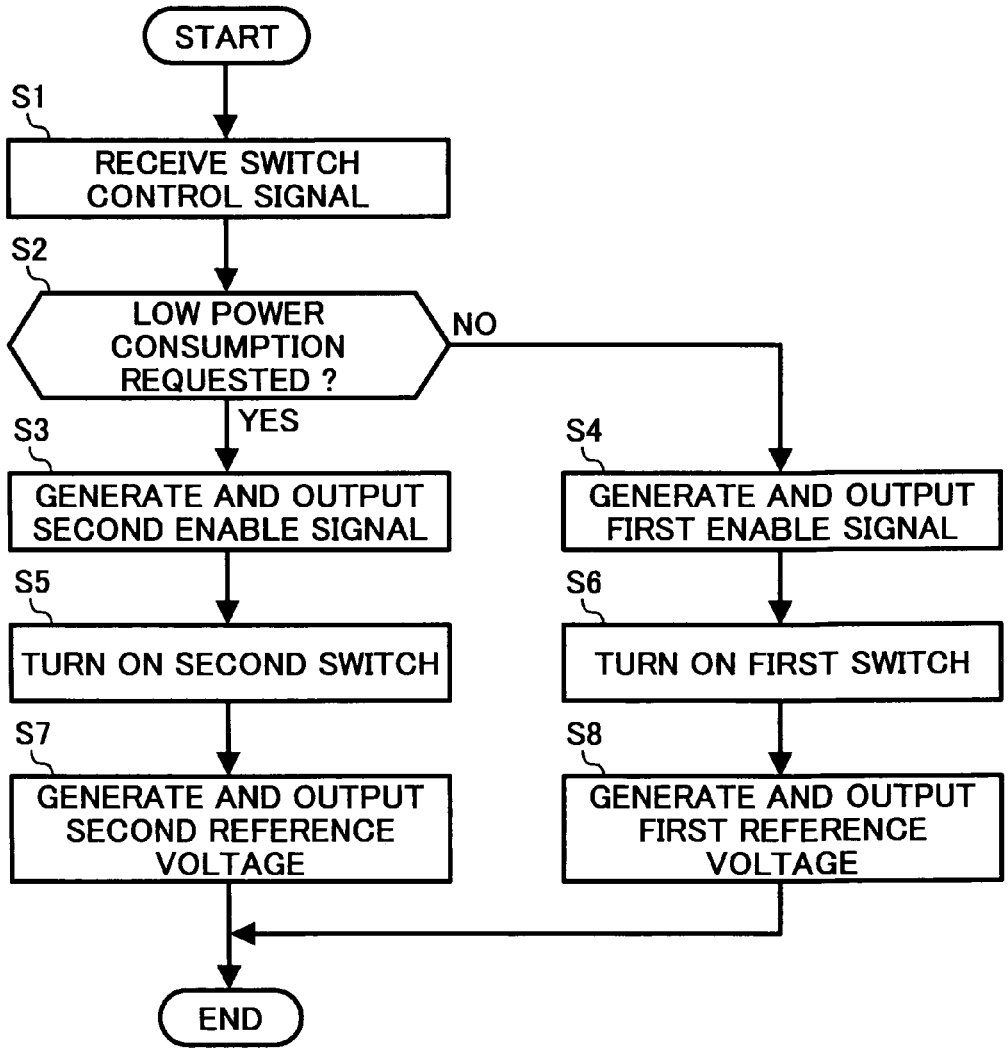
FIG. 2 is a flowchart illustrating a method for generating a reference voltage, performed by the integrated circuit of FIG. 1.

Referring to FIG. 2, a process for generating a reference voltage Vref, performed by the overlap circuit 5, is explained. The overlap circuit 5 may perform the steps shown in FIG. 2 according to a control signal received from the outside of the system, such as from a general-purpose microprocessor or signal processor.

In Step S1, a switch control signal Sc1 is received from the outside, which indicates a functionality of the load 10. For example, the switch control signal Sc1 indicates whether the load 10 in operation prefers low power consumption or it requires constant voltage supply.

It is determined in Step S2 whether the switch control signal Sc1 requests low power consumption. If low power consumption is requested (step S2, YES), the process moves to Step S3. If constant voltage supply is requested (step S2, NO), the process moves to Step S4.

When low power consumption is requested, the overlap circuit 5 performs Steps S3, S5 and S7.

A second enable signal CE2 is generated in step S3, and output to the second switch SW2.

In Step S5, the enable signal CE2 turns on the second switch SW2 to connect the second voltage generating circuit 3 to the rest of the circuit 100. At this time, the first switch SW1 is turned off to disconnect the first voltage generating circuit 2 from the rest of the circuit 100. In this way, the power supply to the first voltage generating circuit 2 is stopped.

The overlap circuit 5 may use a method other than through use of switches, as long as the power supply is stopped.

In Step S7, the second voltage generating circuit 3 generates a second reference voltage Vr2, and outputs it to the amplifier AMP as a reference voltage Vref.

When constant voltage supply is requested, the overlap circuit 5 performs Steps S4, S6 and S8.

A first enable signal CE1 is generated in step S4, and output to the first switch SW1.

In Step S6, the enable signal CE1 turns on the first switch SW1 to connect the first voltage generating circuit 2 to the rest of the circuit 100. At this time, the second switch SW2 is turned off to disconnect the second voltage generating circuit 3 from the rest of the circuit 100. In this way, the power supply to the first voltage generating circuit 2 is stopped.

The overlap circuit 5 may use a method other than the use of switches, as long as the power supply is stopped.

In Step S8, the first voltage generating circuit 2 generates a first reference voltage Vr1, and outputs it to the amplifier AMP as a reference voltage Vref.

Figure 3:
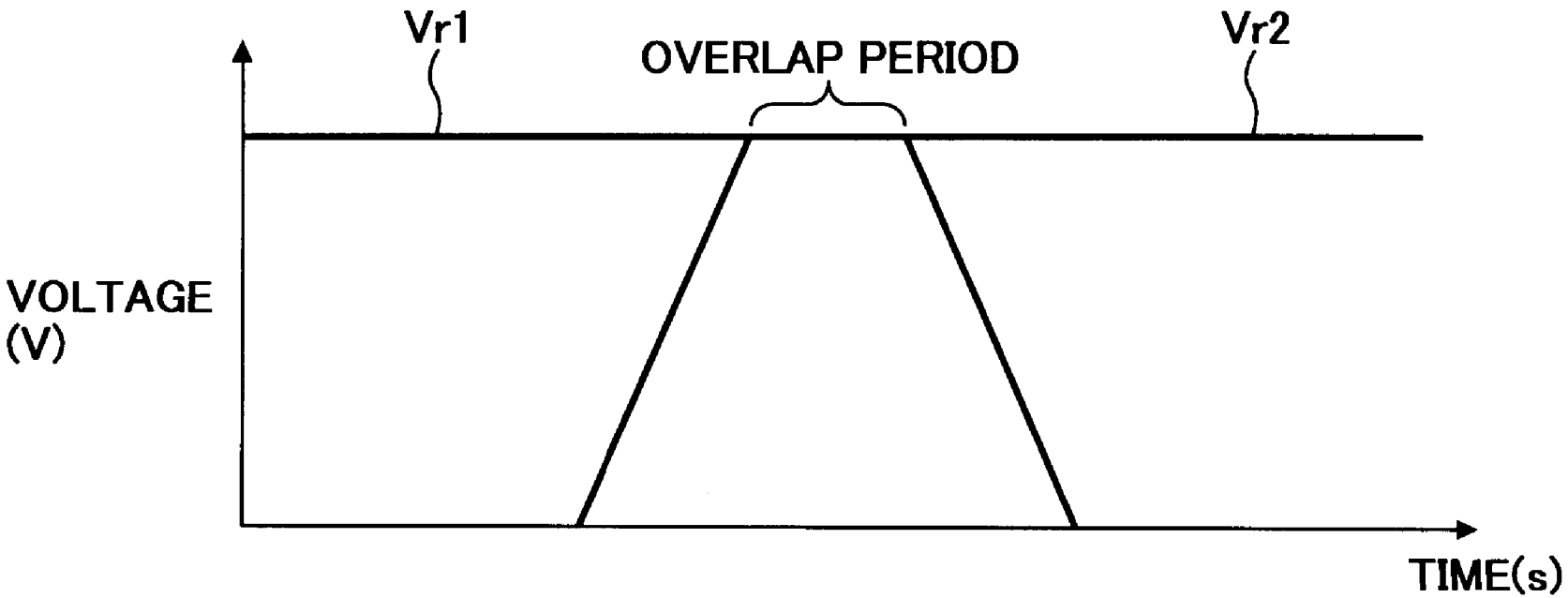
FIG. 3 is a graph illustrating switching between reference voltages, performed by the integrated circuit of FIG. 1.

The overlap circuit 5 repeats the above-described method every time it receives the switch control signal Sc1. When the switch control signal Sc1 is changed during the operation, the overlap circuit 5 switches between the first voltage generating circuit 2 and the second voltage generating circuit 3. In switching operation, the first reference voltage Vr1 and the second reference voltage Vr2 are preferably overlapped in a predetermined time period, as shown in FIG. 3, for smooth operation.

The reference voltage generating circuit 1 of FIG. 1 includes two reference voltage generating circuits (the first voltage generating circuit 2 and the second voltage generating circuit 3), however, the number of reference voltage generating circuits is not limited to this exemplary case.

Figure 4:
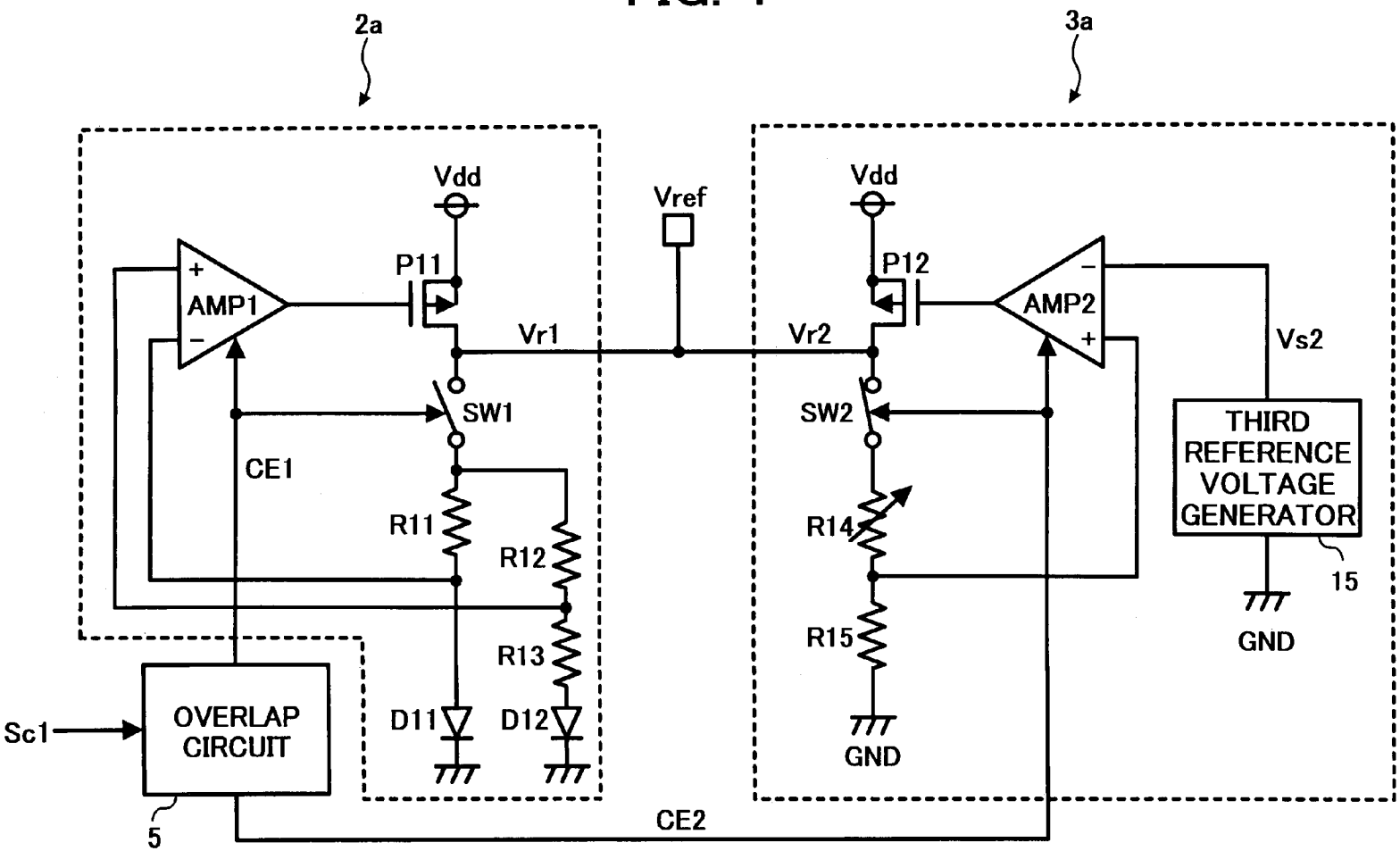
FIG. 4 is a schematic diagram illustrating an exemplary circuit configuration of the reference voltage generating circuit shown in FIG. 1.
Figure 7:
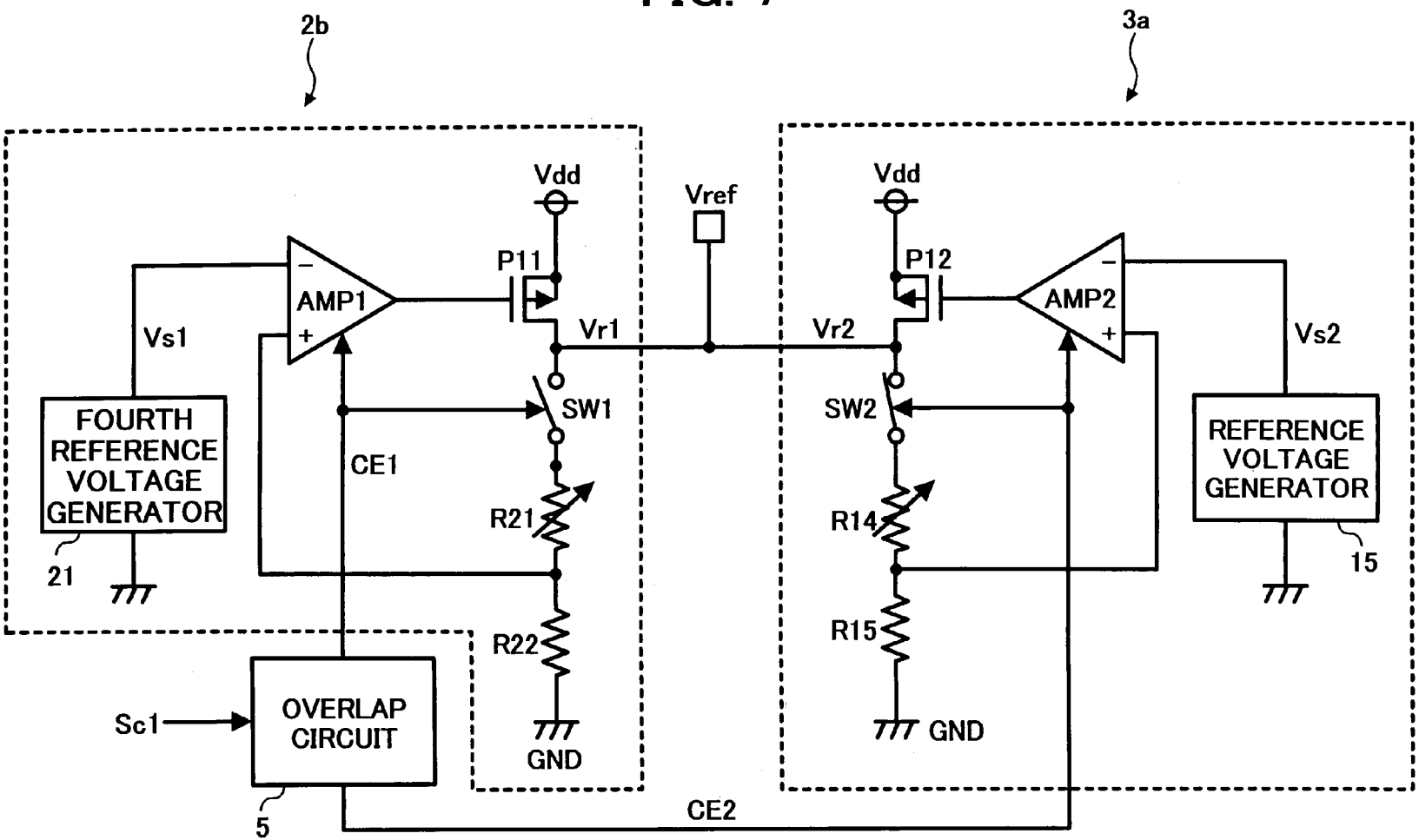
FIG. 7 is a schematic diagram illustrating another exemplary circuit configuration of the reference voltage generating circuit shown in FIG. 1.

Further, the reference voltage generating circuit 1 may include a wide variety of reference voltage generating circuits, including the ones shown in FIGS. 4 and 7, for example.

As shown in FIG. 4, the first voltage generating circuit 2 may be implemented as a bandgap voltage generating circuit 2*a*, including any one of the known bandgap circuits, for example. The second voltage generating circuit 3 may be implemented as an FET (field effect transistor) voltage generating circuit 3*a*, including any one of the known field effect transistors, for example.

The bandgap voltage generating circuit 2*a* includes a first amplifier AMP1, a first output driver P11, a first diode D11, a second diode D12, a first resistor R11, a second resistor R12, and a third resistor R13. The first switch SW1 shown in FIG. 4 corresponds to the first switch SW1 of FIG. 1.

The first output driver P11, the first switch SW1, the first resistor R11, and the first diode D11 are connected in series between the power source Vdd and the ground GND. The junction of the first switch SW1 and the first resistor R11 is connected to the second resistor R12. The third resistor R13, and the second diode D12 are connected in series between the second resistor R12 and the ground GND.

The positive input terminal of the first amplifier AMP1 is connected to the junction of the second resistor R12 and the third resistor R13. The negative input terminal of the first amplifier AMP1 is connected to the junction of the first resistor R11 and the first diode D11. The output terminal of the first amplifier AMP1 is connected to the gate of the first output driver P11. The junction of the first output driver P11 and the first switch SW1 is connected to the negative input terminal of the amplifier AMP of FIG. 1.

As will be apparent to those skilled in the art, the bandgap voltage generating circuit generally has a high temperature sensitivity and a high voltage accuracy. For example, the bandgap voltage generating circuit 2*a* of FIG. 4 has a temperature sensitivity of around tens PPM per degrees C., and outputs a reference voltage Vr1 of around 1.25V.

The FET voltage generating circuit 3*a* includes a second amplifier AMP2, a second output driver P12, a fourth resistor R14 which is trimmed, a fifth resistor R15, and a third reference voltage generator 15. The second switch SW2 shown in FIG. 4 corresponds to the second switch SW2 of FIG. 1.

The second output driver P12, the second switch SW2, the fourth resistor R14, and the fifth resistor R15 are connected in series between the power source Vdd and the ground GND. The negative input terminal of the second amplifier AMP2 is connected to the third reference voltage generator 15, which is connected to the ground GND. The positive input terminal of the second amplifier AMP2 is connected to the junction of the fourth resistor R14 and the fifth resistor R15. The output terminal of the second amplifier AMP2 is connected to the gate of the second output driver P12. The junction of the second output driver P12 and the second switch SW2 is connected to the negative input terminal of the amplifier AMP of FIG. 1.

The third reference voltage generator 15 outputs a reference voltage Vs2 to the second amplifier AMP2. The third reference voltage generator 15 may employ any kind of the known field effect transistors, as shown in FIG. 5, for example.

Figure 5:
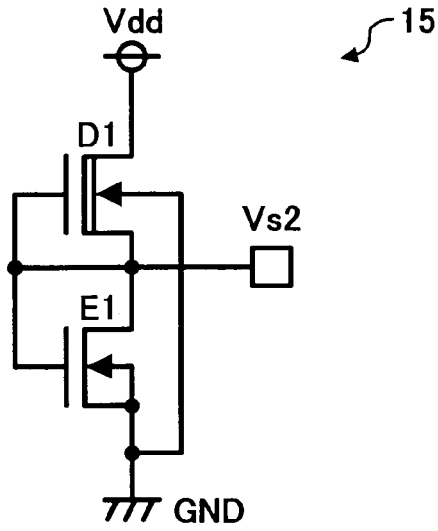
FIG. 5 is a schematic diagram illustrating a reference voltage generator of the reference voltage generating circuit shown in FIG. 4.

Referring to FIG. 5, the third reference voltage generator 15 includes a first field effect transistor D1 and a second field effect transistor E1. For example, the first field effect transistor D1 includes a depression-mode N-channel MOS transistor D1. The second field effect transistor D2 includes an enhancement-mode N-channel MOS transistor E1.

The first transistor D1 and the second transistor E1 are connected in series between the power source Vdd and the ground GND. The gate of the first transistor D1 and the gate of the second transistor E1 are connected with each other. The junction of the first transistor D1 and the second transistor E1 is connected to the source of the first transistor D1 at one end, and to the drain of the second transistor E1 at the other end. Through this junction, the third reference voltage generator 15 outputs the reference voltage Vs2. Further, the respective substrate gates of the first transistor D1 and the second transistor E1 are connected to the ground GND.

Figure 6:
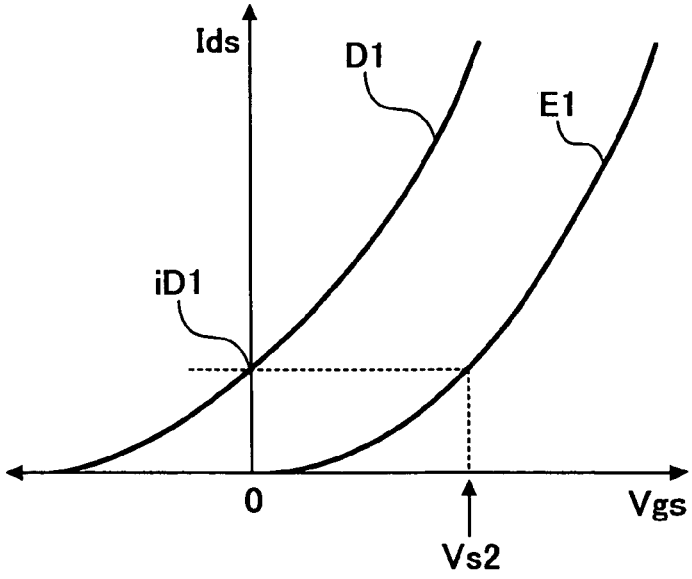
FIG. 6 is a graph illustrating the relationship between gate-to-source voltages and source-to-drain currents, generated by the reference voltage generator shown in FIG. 5.

FIG. 6 illustrates the relationship between the gate-to-source voltage Vgs and the source-to-drain current Ids, given a fixed drain-to-source voltage. As shown in FIG. 6, the first transistor D1, having the gate connected to the ground GND, has a gate voltage of 0V, and outputs a drain current of iD1 to the second transistor E1. The transistor E1 generates a gate voltage of Vs2 as the reference voltage Vref.

As will be apparent to those skilled in the art, the FET voltage generating circuit having a configuration similar to the one shown in FIG. 5 generally has a low consumption rate, preferably below 1 micro Ampere. In this exemplary case, the third reference voltage generator 15 has a temperature sensitivity ranging from 100 PPM per degree C. to 300 PPM per degree C., and generates a reference voltage Vs2 ranging from 0.6V to 1.0V.

Further, the circuit configuration of the third reference voltage generator 15 is not limited to the above-described configuration shown in FIG. 5.

FIG. 7 illustrates another exemplary circuit configuration of the reference voltage generating circuit 1 of FIG. 1. The circuit of FIG. 7 differs from the circuit of FIG. 4, with respect to the first voltage generating circuit 2. Particularly, the first voltage generating circuit 2 of FIG. 7 is implemented as an FET voltage generating circuit 2*b*, including any one of the known field effect transistors. As shown in FIG. 7, the FET voltage generating circuit 2*b* has a structure substantially similar to that of the FET voltage generating circuit 3*a*, except that the third reference voltage generator 15 is replaced with a fourth reference voltage generator 21.

Figure 8:
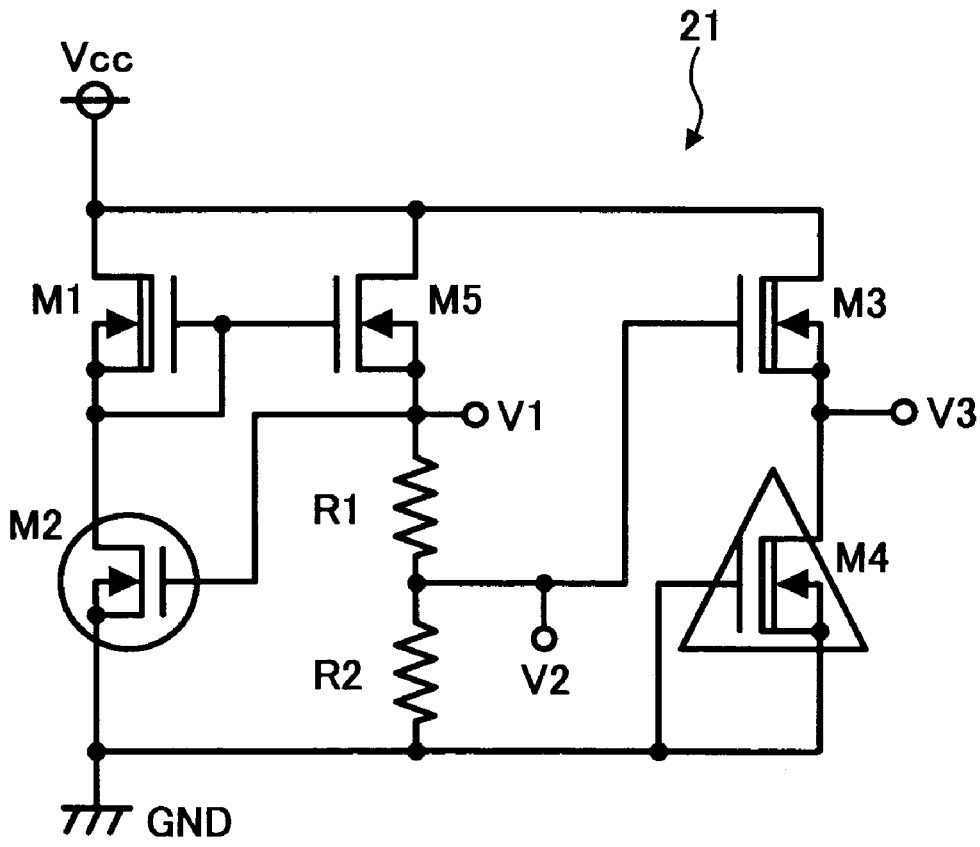
FIG. 8 is a schematic diagram illustrating a reference voltage generator of the reference voltage generating circuit shown in FIG. 7.

The fourth reference voltage generator 21 may have a circuit configuration shown in FIG. 8, for example. The fourth reference voltage generator 21 of FIG. 8 includes four field effect transistors M1 to M5, and two resistors R1 and R2. Detailed description of the reference voltage generator having the circuit configuration of FIG. 8 is disclosed in FIG. 22 of any one of the U.S. Pat. No. 6,347,550 filed on Dec. 27, 2000, and U.S. Pat. No. 6,600,305 filed on Jun. 26, 2002, which are incorporated in their entireties by reference herein.

Further, the circuit configuration of the fourth reference voltage generator 21 is not limited to the above-described configuration shown in FIG. 8 (or FIG. 22 of U.S. Pat. Nos. 6,347,550 and 6,600,305). For example, any kind of the circuit configurations disclosed in U.S. Pat. Nos. 6,347,550 and 6,600,305.

Further, as will be apparent to those skilled in the art and as it is disclosed in U.S. Pat. Nos. 6,347,550 and 6,600,305, the FET voltage generating circuit having a configuration similar to the one shown in FIG. 8 generally has a high temperature sensitivity.

Numerous additional modifications and variations are possible in light of the above teachings. It is therefore to be understood that within the scope of the appended claims, the disclosure of this patent specification may be practiced otherwise than as specifically described herein.

For example, elements and/or features of different illustrative embodiments may be combined with each other and/or substituted for each other within the scope of this disclosure and appended claims.

Further, the reference voltage generating circuit of the present invention may be used in a circuit other than the reference voltage source circuit. For example, it may be used in a charge or discharge detection circuit provided to protect a battery from being excessively charged or discharged.

This patent specification is based on Japanese patent application No. JPAP2003-382835 filed on Nov. 12, 2003, in the Japanese Patent Office, the entire contents of which are incorporated by reference herein.

The invention claimed is:

1. An integrated circuit incorporated in an electronic device, comprising:

a first reference voltage generating circuit configured to generate a first reference voltage;

a second reference voltage generating circuit, having a characteristic different from a characteristic of the first reference voltage generating circuit, configured to generate a second reference voltage; and a controller circuit configured to select one of the first and second reference voltages as a reference voltage, according to a control signal provided from the outside and corresponding to a functionality of the electronic device, wherein the characteristic difference between the first and second reference voltage generating circuits indicates that power consumption of the second reference voltage generating circuit is lower than power consumption of the first reference voltage generating circuit, and wherein the characteristic difference between the first and second reference voltage generating circuit further indicates that a temperature sensitivity of the first reference voltage generating circuit is lower than a temperature sensitivity of the second reference voltage generating circuit.

2. The integrated circuit of claim 1, wherein the characteristic difference between the first and second reference voltage generating circuits further indicates that a voltage accuracy of the first reference voltage generating circuit is higher than a voltage accuracy of the second reference voltage generating circuit.

3. The integrated circuit of claim 1, wherein the second reference voltage generator includes at least one field effect transistor.

4. The integrated circuit of claim 1, wherein the controller stops power supply to the unselected one of the first and second reference voltage generators.

5. The integrated circuit of claim 1, wherein the first reference voltage generator includes a bandgap circuit.

6. The integrated circuit of claim 1, wherein the first reference voltage generator includes at least one field effect transistor.

7. The integrated circuit of claim 1, wherein the controller switches between the first and second reference voltage generating circuit, according to the control signal.

8. The integrated circuit of claim 7, wherein the controller selects both of the first and second reference voltages, in a predetermined time period after the switching.

9. The integrated circuit of claim 1, wherein the control signal indicates functionality of a load.

10. The integrated circuit of claim 9, wherein the controller circuit selects the first reference voltage when the functionality prefers constant voltage supply.

11. The integrated circuit of claim 9, wherein the controller circuit selects the first reference voltage when the functionality prefers accurate voltage supply.

12. The integrated circuit of claim 9, wherein the controller circuit selects the second reference voltage when the functionality prefers low power consumption.

13. The integrated circuit of claim 1, further comprising:

a divider configured to divide an output voltage into a divided voltage; and a comparator configured to compare the divided voltage with the reference voltage.

14. The integrated circuit of claim 13, further comprising:

an output driver configured to control the divided voltage according to the comparison result of the comparator, and to output the controlled divided voltage to the outside.

15. An integrated circuit incorporated in an electronic device, said integrated circuit comprising:

a first reference voltage generating circuit configured to generate a first reference voltage;

a second reference voltage generating circuit, having a characteristic different from a characteristic of the first reference voltage generating circuit, configured to generate a second reference voltage; and a controller circuit configured to select one of the first and second reference voltages as a reference voltage, according to a control signal corresponding to a functionality of the electronic device, wherein the characteristic difference between the first and second reference voltage generating circuits indicates that a temperature sensitivity of the first reference voltage generating circuit is lower than a temperature sensitivity of the second reference voltage generating circuit, and wherein the characteristic difference between the first and second reference voltage generating circuits further indicates that a voltage accuracy of the first reference voltage generating circuit is higher than a voltage accuracy of the second reference voltage generating circuit.

16. The integrated circuit of claim 15, further comprising:

an output terminal configured to output the reference voltage to a load.

17. The integrated circuit of claim 15, wherein the second reference voltage generator includes at least one field effect transistor.

18. The integrated circuit of claim 15, wherein the controller stops power supply to the unselected one of the first and second reference voltage generators.

19. The integrated circuit of claim 15, wherein the first reference voltage generator includes a bandgap circuit.

20. The integrated circuit of claim 15, wherein the first reference voltage generator includes at least one field effect transistor.

21. An electronic device, comprising:

a divider configured to divide an output voltage into a divided voltage;

a first reference voltage generating circuit configured to generate a first reference voltage;

a second reference voltage generating circuit, having a characteristic different from a characteristic of the first reference voltage generating circuit, configured to generate a second reference voltage;

a controller circuit configured to select at least one of the first and second reference voltages as a reference voltage, according to a control signal received from the outside and corresponding to a functionality of the electronic device; and a comparator configured to compare the divided voltage with the reference voltage, wherein the characteristic difference between the first and second reference voltage generating circuits indicates that a temperature sensitivity of the first reference voltage generating circuit is lower than a temperature sensitivity of the second reference voltage generating circuit.

22. The electronic device of claim 21, wherein the first reference voltage generating circuit includes a bandgap circuit.

23. The electronic device of claim 21, wherein the first reference voltage generating circuit includes at least one field effect transistor.

24. The electronic device of claim 21, wherein the second reference voltage generating circuit includes at least one field effect transistor.

25. The electronic device of claim 24, wherein the first reference voltage generating circuit includes a bandgap circuit.

26. The electronic device of claim 24, wherein the first reference voltage generating circuit includes at least one field effect transistor.

27. The electronic device of claim 21, further comprising:

an output driver configured to control the divided voltage according to the comparison result of the comparator.

28. The electronic device of claim 27, wherein the first reference voltage generator includes a bandgap circuit.

29. The electronic device of claim 27, wherein the first reference voltage generator includes at least one field effect transistor.

30. The electronic device of claim 27, wherein the second reference voltage generator includes at least one field effect transistor.

31. The electronic device of claim 30, wherein the first reference voltage generator includes a bandgap circuit.

32. The electronic device of claim 30, wherein the first reference voltage generator includes at least one field effect transistor.

33. A reference voltage selecting system incorporated in an electronic device, comprising:

first generating means for generating a first reference voltage;

second generating means for generating a second reference voltage, with a power consumption rate lower than a power consumption rate of the first generating means;

obtaining means for obtaining a control signal provided from the outside and corresponding to a functionality of the electronic device; and selecting means for selecting one of the first and second reference voltages according to the control signal, wherein a temperature sensitivity of the first generating means is lower than a temperature sensitivity of the second generating means.

34. The system of claim 33, wherein a voltage accuracy of the first generating means is higher than a voltage accuracy of the second generating means.

35. The system of claim 33, wherein the second generating means includes at least one field effect transistor.

36. The system of claim 34, wherein the first generating means includes a bandgap circuit.

37. The system of claim 34, wherein the first generating means includes at least one field effect transistor.

38. A reference voltage selecting method for an electronic device, comprising the steps of:

generating a plurality of reference voltages having characteristics different from one another;

obtaining a control signal from the outside which corresponds to a functionality of the electronic device;

selecting one of the plurality of reference voltages according to the control signal; and outputting the selected one of the plurality of reference voltages, wherein the plurality of reference voltages includes:

a first reference voltage; and a second reference voltage having a power consumption rate lower than a power consumption rate of the first reference voltage, and wherein a temperature sensitivity of the second reference voltage is higher than a temperature sensitivity of the first reference voltage.

39. The method of claim 38, wherein the control signal indicates functionality of a load.

40. The method of claim 39, wherein the selecting step selects the first reference voltage, when the functionality prefers constant voltage supply.

41. The method of claim 39, wherein the selecting step selects the second reference voltage, when the functionality prefers low power consumption.

42. An integrated circuit incorporated in an electronic device, comprising:

a first reference voltage generating circuit configured to generate a first reference voltage;

a second reference voltage generating circuit configured to generate a second reference voltage, said second reference voltage generating circuit having a characteristic different from a characteristic of the first reference voltage generating circuit; and a controller circuit configured to select at least one of the first and second reference voltages as a reference voltage, according to a control signal provided from the outside and corresponding to a functionality of the electronic device, wherein the characteristic difference between the first and second reference voltage generating circuits indicates that a temperature sensitivity of the first reference voltage generating circuit is lower than a temperature sensitivity of the second reference voltage generating circuit.

43. The integrated circuit of claim 42, wherein the characteristic difference between the first and second reference voltage generating circuits indicates that power consumption of the second reference voltage generating circuit is lower than power consumption of the first reference voltage generating circuit.

44. The integrated circuit of claim 42, wherein the characteristic difference between the first and second reference voltage generating circuits indicates that a voltage accuracy of the first reference voltage generating circuit is higher than a voltage accuracy of the second reference voltage generating circuit.

45. The integrated circuit of claim 42, wherein the controller circuit selects the first reference voltage when constant voltage supply is preferred for the functionality of the electronic device.

46. The integrated circuit of claim 42, wherein the controller circuit selects the first reference voltage when accurate voltage supply is preferred for the functionality of the electronic device.

47. The integrated circuit of claim 42, wherein the controller circuit selects the second reference voltage when low power consumption is preferred for the functionality of the electronic device.

48. A reference voltage selecting method for an electronic device, comprising the steps of:

generating, through a first reference voltage generating circuit, a first reference voltage;

generating a second reference voltage through a second reference voltage generating circuit having characteristics different from the first reference voltage generating circuit;

obtaining a control signal from the outside which corresponds to a functionality of the electronic device;

selecting at least one of the first and second reference voltages according to the control signal; and outputting the selected one of the first and second reference voltages, wherein the characteristic difference between the first and second reference voltage generating circuits indicates that a temperature sensitivity of the first reference voltage generating circuit is lower than a temperature sensitivity of the second reference voltage generating circuit.

49. The method of claim 48, wherein the first reference voltage is selected when constant voltage supply is preferred for the functionality of the electronic device.

50. The integrated circuit of claim 48, wherein the first reference voltage is selected when accurate voltage supply is preferred for the functionality of the electronic device.

51. The integrated circuit of claim 48, wherein the first reference voltage is selected when low power consumption is preferred for the functionality of the electronic device.

* * * * *